United States Patent [19]

Kennedy et al.

[11] 4,082,331

[45] Apr. 4, 1978

[54] DOOR FOR A MINE STOPPING

[76] Inventors: John M. Kennedy; William R. Kennedy, both of P.O. Box 38, Taylorville, Ill. 62568

[21] Appl. No.: 738,690

[22] Filed: Nov. 4, 1976

[51] Int. Cl.[2] ..... E05C 5/00

[52] U.S. Cl. ..... 292/228; 292/128

[58] Field of Search ..... 292/128, 129, 57-69, 292/109-115

[56] References Cited

U.S. PATENT DOCUMENTS

| | | | |
|---|---|---|---|
| 970,661 | 9/1910 | Stoddard | 292/128 |
| 1,128,502 | 2/1915 | Pinnow | 292/128 |
| 1,451,662 | 4/1923 | Forbes | 292/114 |
| 2,020,188 | 11/1935 | Johnson | 292/114 X |
| 2,272,825 | 2/1942 | Anderson | 292/128 |

*Primary Examiner*—Richard E. Moore

*Attorney, Agent, or Firm*—Koenig, Senniger, Powers and Leavitt

[57] ABSTRACT

A door for a doorway in a mine stopping having latch means adapted to yield to maintain the door latched on heaving of the sill of the doorway.

8 Claims, 3 Drawing Figures

1
2
3
3A
5
7
9
11
13
15
17
19
20
21
23
25

DOOR FOR A MINE STOPPING

BACKGROUND OF THE INVENTION

This invention relates to doors for mine stoppings, and more particularly to so-called "man doors" for use on masonry and metal mine stoppings.

So-called "stoppings" are widely used in mines to stop off flow of air in passages in the mines, a "stopping" generally being a masonry (e.g., concrete block) or metal wall installed at the entrance of a passage to block flow of air therethrough. It is often desired that such stoppings be provided with a door, which is referred to as a "man door", for occasional access to the blocked-off passage. A serious problem is encountered, however, in providing a door for a stopping because the floors of passages in mines often heave up, which may result in the door becoming unlatched and opening up for undesired flow of air therethrough, or becoming jammed, and because there may be a relative shifting of the floor, which also may result in the door becoming unlatched or becoming jammed.

SUMMARY OF THE INVENTION

Accordingly, among the several objects of this invention may be noted the provision of a door for a mine stopping which is adapted to remain latched despite heaving or lateral shifting of the floor of the passage in the mine in which the stopping is installed; the provision of such a door which does not become jammed on such heaving or shifting and which is adapted readily to be unlatched and opened for access to the blocked-off passage even after such heaving or shifting; and the provision of such a door which, while being effective for its purpose, is of simple and economical construction.

In general, a door of this invention for closing a doorway in a mine stopping has hinge means at an edge thereof for hingedly mounting the door to swing on an axis adjacent an edge of the doorway between a closed position engaging a face of the stopping all around the doorway and an open position swung away from the doorway. A latch is provided for latching the door closed, the latch comprising a bar extending through an opening in the door adjacent an edge of the door from the outside toward the inside of the door and adapted to extend into the doorway. The bar has a detent portion adjacent its inner end and is movable inwardly and outwardly and swingable in said opening for engagement of said detent portion behind part of the stopping to latch the door in its closed position. Spring means is provided biasing the bar to move outwardly in the opening.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figures 1, 2, 3:
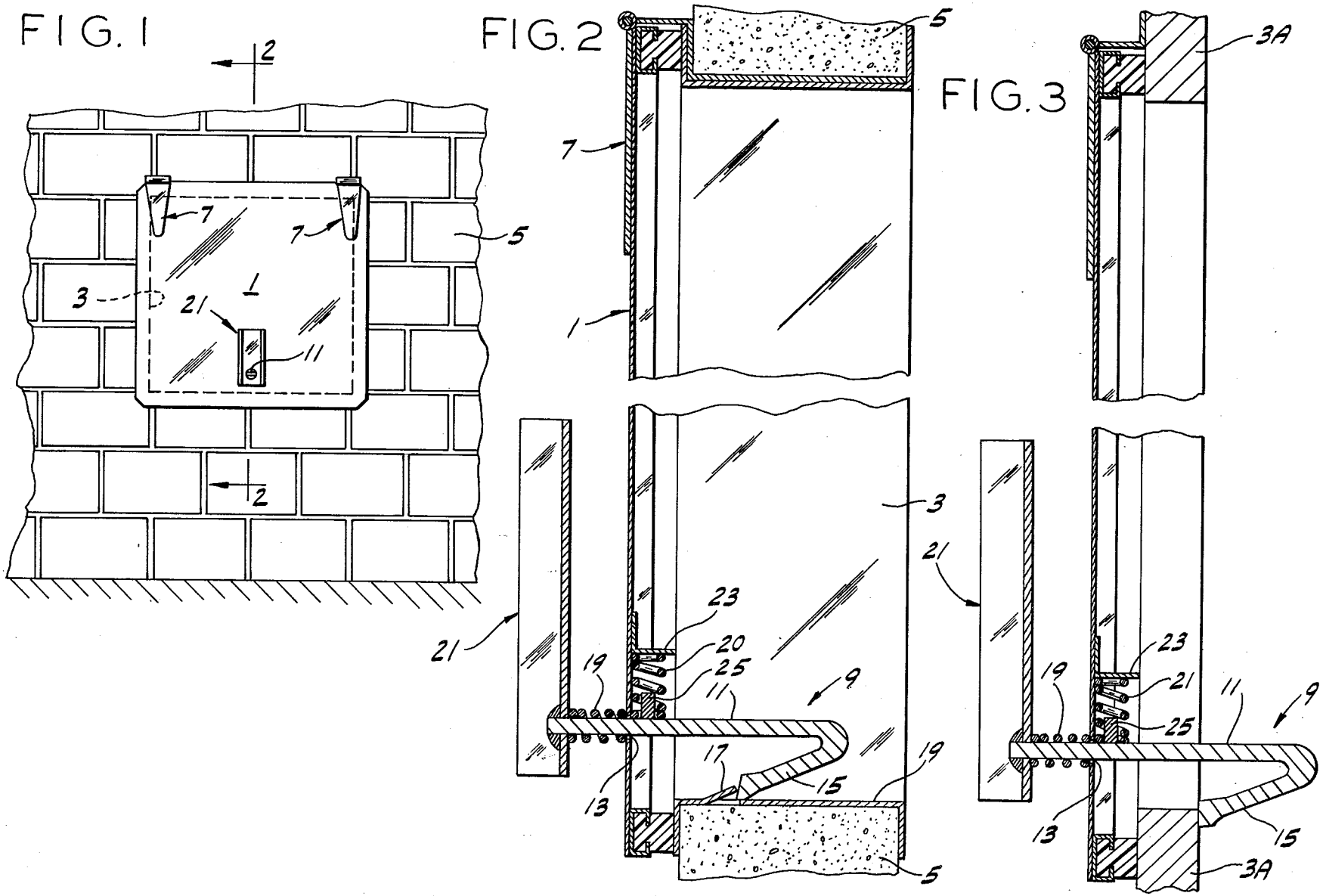
FIG. 1. is a front elevation of a door of this invention for a doorway in a masonry mine stopping.
FIG. 2. is an enlarged vertical section on line 2—2 of FIG. 1.
FIG. 3. is a view similar to FIG. 2 showing the door applied to a metal mine stopping.

Referring to the drawings, FIGS. 1 and 2 show a door 1 of this invention for closing a doorway 3 in a masonry mine stopping 5, e.g., a concrete block mine stopping. The door has hinge means 7 at an edge thereof, more particular its upper edge, for hingedly mounting the door to swing on a generally horizontal axis adjacent the upper edge of the doorway between the closed position shown in the drawings engaging the outside face of the stopping all around the doorway and an open position swung up away from the doorway. A latch generally designated 9 is provided for latching the door closed.

The latch 9 comprises a metal bar 11 (shown as a bar of relatively flat rectangular cross section) extending through an opening 13 in the door on the vertical center line of the door adjacent the bottom edge of the door from the outside toward the inside of the door and adapted to extend into the doorway 3. The bar 11 has its inner end portion bent to extend down from the bar to provide a hook-like detent portion 15 adjacent the inner end of the bar. The bar is movable inwardly and outwardly in the opening 13 and pivotable in the opening 13, i.e., swingable about an axis transverse to the bar, for engagement of said hook-like detent portion 15 behind a part of the stopping to latch the door in its closed position. As herein illustrated for the masonry stopping, this part of the stopping engageable by the detent portion 15 of the bar is constituted by a struck-up lug 17 on a metal sill member 19 straddling the bottom of the doorway.

Spring means 19 is provided biasing the bar 11 outwardly (forward) in the opening 13 to the forward position in which it appears in FIG. 2. This spring means comprises a coil compression spring surrounding the bar on the outside of the door reacting from the outer face of the door against a handle 21 on the outer end of the bar. The handle extends up from the bar and is adapted to be moved down to cause the bar to swing counterclockwise as viewed in FIG. 2 to swing the detent portion 15 of the bar up. The bar is biased to swing clockwise as viewed in FIG. 2 to swing the detent portion 15 of the bar down by a second spring means constituted by a coil compression spring 20 on the inside of the door compressed between a lug 23 on the door and the top of the bar and held in place by a spring centering pin 25 extending up from the bar.

With the detent portion 15 of the bar 11 engaged behind the lug 17 at the bottom of the doorway 3, the door is latched closed. Even though the floor of the passage blocked by the stopping 5 may heave up, causing the sill of the doorway 3 to heave up, the door 1 will remain latched, bar 11 being free to swing counterclockwise relative to the door as the sill heaves up to accomodate the upheaval of the sill relative to the door and the detent portion 15 remaining latched behind the lug. The door may be opened at any time, even after upheaval of the sill (within reasonable limits), by tilting handle 21 outwardly with accompanying downward movement thereof to swing the bar 11 upwardly, thereby moving the detent portion 15 rearwardly and upwardly to clear the lug to enable the door to be swung up. The arrangement is also such as to maintain the door latched, and to allow it to be opened, upon relative lateral shift of the sill (as may occur on what is referred to as "parallelogramming" of the doorway.

FIG. 3 shows the door 1 as applied to a metal stopping 3A. Here the door is basically the same as above described, the principal difference being that the detent portion 15 hooks behind the edge of the stopping itself at the bottom of the doorway in the stopping.

Generally, the hinge means at the door will be at the top of the doorway in the stopping. However, it will be understood that in some instances the door may be mounted with the hinge means at the bottom of the doorway, or at a side of the doorway.

In the preferred construction of the door of this invention, the spring 19 is a relatively strong spring, which effectively holds the bar 11 and handle 21 in the outer (forward) position shown in FIG. 2, yielding when the handle is tilted downwardly to release the latch. The pin 25 in conjunction with the lower end of the spring 20 acts as a stop limiting the outward movement of the bar 11 under the bias of the spring 19 when the detent portion 15 is disengaged from behind lug 17.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A door for closing a doorway in a mine stopping, said door having hinge means at an edge thereof for hingedly mounting the door to swing on an axis adjacent an edge of the doorway between a closed position engaging a face of the stopping all around the doorway and an open position swung away from the doorway, a latch for latching the door closed, said latch comprising a bar extending through an opening in the door adjacent an edge of the door from the outside toward the inside of the door and adapted to extend into the doorway, said bar having a detent portion adjacent its inner end, said bar being movable inwardly and outwardly in said opening and being swingable in said opening about an axis transverse to the bar for engagement of said detent portion behind part of the stopping to latch the door in its closed position, and spring means reacting from the door on the bar to bias the bar outwardly in the opening to ensure engagement of said detent portion behind said part of the stopping to latch the door in its closed position.

2. A door for closing a doorway in a mine stopping, said door having hinge means at an edge thereof for hingedly mounting the door to swing on an axis adjacent an edge of the doorway between a closed position engaging a face of the stopping all around the doorway and an open position swung away from the doorway, a latch for latching the door closed, said latch comprising a bar extending through an opening in the door adjacent an edge of the door from the outside toward the inside of the door and adapted to extend into the doorway. said bar having a detent portion adjacent its inner end, said bar being movable inwardly and outwardly in said opening and being swingable in said opening for engagement of said detent portion behind part of the stopping to latch the door in its closed position, first spring means reacting from the door on the bar to bias the bar outwardly in the opening, and second spring means biasing the bar to swing in the direction for engagement of said detent portion with said part of the stopping.

3. A door as set forth in claim 1 wherein said bar has a handle at its outer end and said spring means comprises a compression spring reacting from the outside of the door against the handle to tend to push the bar outwardly with respect to the door.

4. A door as set forth in claim 2 wherein said bar has a handle at its outer end, said first spring means comprises a compression spring reacting from the outside of the door against the handle to tend to push the bar outwardly with respect to the door, and said second spring means comprises a second spring on the inside of the door.

5. A door as set forth in claim 1 wherein said hinge means is at the top of the door and said bar is adjacent the bottom of the door, said detent portion being below the bar and being engageable with part of the stopping at the bottom of the doorway.

6. A door as set forth in claim 2 wherein said hinge means is at the top of the door, said bar is adjacent the bottom of the door, said detent portion being below the bar and being engageable with part of the stopping at the bottom of the doorway, and the second spring means biases the bar to swing down at its inner end for engagement of said detent portion with said part of the stopping at the bottom of the doorway.

7. A door as set forth in claim 6 wherein said detent portion of the bar is formed by an end portion of the bar bent to extend down from the bar.

8. A door as set forth in claim 7 wherein the bar has a handle at its outer end extending up from the bar, the first spring means comprises a compression spring reacting from the outside of the door against the handle to tend to push the bar outwardly with respect to the door, and the second spring means comprises a compression spring compressed between a lug on the inside of the door and the top of the bar.

* * * * *